United States Patent [19]

Shibata et al.

[11] Patent Number: 4,776,070

[45] Date of Patent: Oct. 11, 1988

[54] DIRECTLY-HEATING ROLLER FOR FIXING TONER IMAGES

[75] Inventors: Ryoichi Shibata, Saitama; Tsutomu Iimura, Tokyo, both of Japan

[73] Assignee: Hitachi Metals, Ltd., Tokyo, Japan

[21] Appl. No.: 24,172

[22] Filed: Mar. 10, 1987

[30] Foreign Application Priority Data

Mar. 12, 1986 [JP] Japan ..... 61-54463
Mar. 12, 1986 [JP] Japan ..... 61-54464
Mar. 12, 1986 [JP] Japan ..... 61-54462

[51] Int. Cl.[4] ..... B21B 27/00
[52] U.S. Cl. ..... 29/130; 29/132
[58] Field of Search ..... 29/130, 132; 219/469, 219/471, 216, 244, 388; 338/212, 223, 224, 225; 432/60, 228; 100/93 RR

[56] References Cited

U.S. PATENT DOCUMENTS 3,425,864 2/1969 Morey .
3,557,576 1/1971 Baum .
3,612,170 10/1971 Lyon .
3,649,810 3/1972 Tsuboi et al. .
3,679,473 6/1972 Blatchford .
3,794,518 2/1974 Howell .
3,968,347 7/1976 Isoard .
4,060,663 11/1977 Merz et al. .
4,112,193 7/1978 Higuchi et al. .
4,136,611 1/1979 Watanabe et al. .
4,299,887 11/1981 Howell .
4,395,109 7/1983 Nakajima et al. .
4,465,727 8/1984 Fujita et al. .
4,596,920 6/1986 Inagaki .

FOREIGN PATENT DOCUMENTS 992103 4/1951 France .
1377471 9/1964 France .
1903986 8/1970 Fed. Rep. of Germany .
60-140693 4/1985 Japan .
1057982 10/1967 United Kingdom .

*Primary Examiner*—P. W. Echols
*Assistant Examiner*—Irene Cuda
*Attorney, Agent, or Firm*—Finnegan, Henderson, Farabow, Garrett and Dunner

[57] ABSTRACT

The roller has a roller body having a small electrical resistivity, a bonding layer formed substantially uniformly on the outer peripheral surface of the roller body, a lower insulating layer provided on the bonding layer; a heat generating layer provided on the lower insulating layer and a ceramic matrix and a metallic resistance layer, constituted by a metal dispersed in the ceramic matrix, the metallic resistance layer extending substantially continuously in the lengthwise direction of the roller, a heat generating layer, an upper insulating layer provided on the heat generating layer, a protective layer formed on the upper insulating layer so as to prevent offset of the toner images, an electrode layer formed on each end of the roller and adapted to connect the heat generating layer to an external power source; and side protective layers covering at least the side surface of the heat generating layer, and the side surfaces and the axially outside surfaces of the lower insulating layer.

19 Claims, 3 Drawing Sheets

DIRECTLY-HEATING ROLLER FOR FIXING TONER IMAGES

FIELD OF THE INVENTION

This invention relates to a directly-heating roller for fixing toner images on a paper or a sheet in electrophotographic copiers, printers, and others, particularly to improvements in the protection of electrical paths in the roller.

BACKGROUND OF THE INVENTION

Electrophotographic copiers and printers make use of toners for developing electrostatic latent images. The developed images are fixed on sheets or like members to form permanent visual images. Broadly, there are two types of methods for fixing the developed images: namely, a method called "heat fuse-fixing" in which resin particles in the toner are heated and fused on the sheet, and a method called "pressure fixing" in which resin particles are fixed by application of pressure.

On the other hand, a device which is referred to as a "heat roller fixing device" has been broadly used because of its superior characteristics, namely, stable fixing performance over a wide speed range of the developing machine, high thermal efficiency and safety. This device has a heat roller which is heated by a tungsten halogen lamp provided inside the roller. This construction understandably requires a large electric power consumption and long warming-up time. In addition, the roller temperature is lowered when many sheets are treated successively, because the heat output cannot compensate for the temperature drop of the roller.

Thus, shorter warm-up time, reduced electric power consumption and smaller temperature drop are important requisites for the heat roller. More practically, the warm-up time is preferably 30 seconds, more preferably 20 seconds or shorter, while the electric power consumption is preferably less than 1 KW, more preferably about 700 W or smaller. It is also preferred that the roller temperature is stably maintained around 200° C.

In order to develop a heat roller which can be heated up in the short time mentioned above, after an intense study, it was proposed that, from a view point of electric resistivity, a resistance film produced from a Ni-Cr alloy and a ceramic material by an arc-plasma spraying method can suitably be used as a heat generator for this type of heat roller. (see copending patent application Ser. No. 686,850 (now abandoned) in the U.S. or EPC patent application No. 84 30 8907.9 assigned to the same assignee).

In the case of a heat roller which has a short warm-up time, the roller temperature is raised to about 200° C. in a very short time of 30 seconds or less as stated above.

An important requisite for the heat roller is that the roller exhibit a uniform temperature distribution over its entire surface. Generally, the heat roller tends to exhibit a higher temperature at its mild portion than at its axial ends. This tendency is increased particularly when the resistance film has a positive temperature coefficient, i.e., such a characteristic that the electric resistance is increased in accordance with a temperature rise. Namely, in such a case, the portion of the resistance film on the mid portion of the roller exhibits a greater resistance than the film portions on both axial ends of the roller, so that the electric current which flows from one to the other axial ends encounters a greater resistance at the mid portion of the roller. Thus, more heat is generated at this portion of the roller thereby causing a further temperature rise at the mid portion of the roller. In order to attain a uniform temperature rise, therefore, it is preferred that the resistance film not have a large positive temperature coefficient.

The resistance film could have a negative temperature coefficient, that is, such a characteristic that electric resistance decreases as temperature rises. In such a case, the heat generation is smaller at the mid portion of the roller than at both axial end portions of the same, contributing to a uniform temperature distribution along the axis of the roller. However, when the roller temperature is still low, the resistance film exhibits a very large electric resistance such as to restrict the flow of the electric current, so that an impractically long time is required for heating up the roller. Thus, the use of a resistance film having a negative temperature coefficient does not meet the demand for shortening the warm-up time. The control of the temperature of the resistance film is accomplished by a control circuit which judges the film temperature by sensing the electric current and varying the electric current in accordance with the measured temperature so as to maintain a constant film temperature. A resistance film having a negative temperature coefficient reduces its resistance when the temperature becomes high. If the electric resistance of a circuit for supplying the electric power increase unexpectedly reason such as due to insufficient contact area at the terminals or contacts in the circuit, the temperature control circuit erroneously judges that the resistance film temperature has decreased and operates to supply greater electric current to the resistance film. From the view point of stability of the temperature control, therefore, it is preferred that the resistance film has a positive temperature coefficient. And when the temperature increases abnormally such as by a relay short, a resistance film having a negative temperature coefficient is rapidly over heated since electric current increases with an increase in temperature for this type of resistance film.

Also, constant load is desired and it is preferred that resistance value of the resistance film is as constant as possible.

SUMMARY OF THE INVENTION

In view of the above mentioned aspects, we propose a directly-heating roller for fuse-fixing toner images as shown in FIG. 2 which comprises: (a) a roller body having a small electrical resistivity 1; (b) a bonding layer formed substantially uniformly on the outer peripheral surface of the roller body 2; (c) a lower insulating layer 3 provided on the bonding layer; (d) a heat generating resistance layer 4 provided on the lower insulating layer and having a ceramic matrix and a metallic resistance layer constituted by a metal dispersed in the ceramic matrix, the metallic resistance layer extending substantially electrically continuously at least in the lengthwise direction of the roller, the heat generating resistance layer having a thermal expansion coefficient substantially the same as that of the lower insulating layer; (e) an upper insulating layer 7 provided on the heat generating layer; (f) an offset preventing layer 8 formed on the upper insulating layer so as to prevent offset of the toner images; and (g) an electrode layer 5 having a ring shape formed on each end of the roller and adapted to connect the heat generating layer to an external power source.

The heat generating layer has a ceramic matrix and a metallic resistor embedded in the matrix, the metallic resistor extending continuously at least in the longitudinal direction. This heat generating layer has a thermal expansion coefficient which is substantially the same as the insulating material. The heat generating layer has an adequate resistivity.

The bonding layer 2 is deposited substantially uniformly onto the outer peripheral surface of the roller portion of a cylindrical roller body 1. A lower insulating layer 3 is deposited on the bonding layer 2, and a heat generating resistance layer 5 is formed on the lower insulating layer 3. An upper insulating layer 7 is formed on the heat generating resistance layer 5. Finally, a protective layer 8 is provided on the upper insulating layer 7. An electrode layer 5 having a ring shape is formed on the portion of the heat generating resistance layer 4 on each axial end portion of the roller 1. Thus, electricity is supplied by means of a brush-type of feeder 6 to the heat generating resistance layer through the electrode layer 5 provided on both axial end portions of the roller body 1.

The directly-heating roller having the described construction, when incorporated in a copier or a similar machine, is journaled at its both ends by bearings for rotation. The directly-heating roller is arranged to oppose a rubber roller such as to form therebetween a nip through which a sheet carrying a toner image is passed so that the toner images can be fixed.

Preferably, the heat generating resistance layer 4 is formed from a material having a composition containing 10 to 35 wt% of an Ni-Cr alloy and the balance substantially a ceramic material. The heat generating resistance layer 4 is produced from the above-mentioned material by arc-plasma spraying, such that the Cr-Ni alloy is dispersed so as to form a lengthwise continuous layer in the ceramic material. When the Ni-Cr alloy content is below 10 wt%, the alloy is dispersed discontinuously, so that the continuous lengthwise layer cannot be formed, with a result that the heat generating resistance layer exhibits a very large resistance. In addition, cracks are apt to be caused around the discontinuities of the heat generating resistance layer, as the roller is subjected to repeated thermal shocks during operation. On the other hand, when the Ni-Cr alloy content exceeds 35 wt%, the specific resistance of the heat generating layer is as low as $10^{-3}$ ohm-cm at the greatest, so that the layer 4 cannot practically serve as a heat generating layer. In addition, the thermal expansion coefficient of the layer is increased to a level of $10\times10^{-6}$/deg. which is too large as compared with that of the heat insulating layers sandwiching the heat generating resistance layer.

Any Ni-Cr alloy ordinarily used as a heat-generating conductive means can be used as the Ni-Cr alloy in the heat generating resistance layer 4. However, in order to obtain a directly-heating roller having a very short warm-up time, it is preferred that the Ni-Cr alloy contains 5 to 20 wt% of Cr and the balance substantially Ni, although some other additives included in heat generating resistance layer and incidental elements are not excluded.

The ceramic matrix of the heat generating resistance layer is preferably formed from $Al_2O_3$. It has been confirmed that when $Al_2O_3$ is used as the ceramic matrix, the Ni-Cr alloy can be well dispersed in the matrix in such a manner as to form a continuous lengthwise layer. The layer of Ni-Cr alloy electronically connect each other in the axial direction of the roller and form electrically continuous layers. Since the Ni-Cr alloy exists as continuous layers in the ceramic matrix, the alloy permits the heat generating resistance layer to withstand repeated thermal shock and affords an adequate specific resistance which ranges between about $10^{-1}$ and $10^{-2}$ ohm-cm. A heating material comprising 8 wt% Ni-Cr alloy is described in Yasuo Tsukuda et al. Ser. No. 686,850 in the U.S. and EPC patent application No. 84308907.9 assigned to the same assignee.

Since this heat generating resistance layer has a thermal expansion coefficient of $6\times10^{-6}$ to $10\times10^{-6}$/deg., it is preferred that the insulating layers sandwiching this heat generating resistance layer have a thermal expansion coefficient of not smaller than $6\times10^{-6}$/deg. Insulating layer materials practically usable are: $Al_2O_3$, MaO, $ZrO_2$, $MgAlO_2O_4$(spinel), $ZrO_2.SiO_2$, MnO.NiO, etc. Among these elements, the spinel $MgAl_2O_4$ is preferred because of the high temperature preservation effect which in turn contributes to the shortening of the warm-up time of the roller.

The lower insulating layer electrically insulates the heat generating resistance layer from the roller body and prevents transfer of heat from the resistance layer to the roller body. Too large a thickness of the lower insulating layer will result in a long warm-up time of the heating roller because of the long time required for heating the lower insulating layer, while too small a thickness cannot provide sufficient electric insulation. For simultaneously satisfying both demands for shorter heating-up time and higher insulation, the thickness of the lower insulating layer preferably ranges between 200 and 500 μm, and most preferably about 300 μm.

The upper insulating layer serves to even out the temperature distribution which otherwise tends not to be uniform due to the non-uniformity of heat generation caused by the partial non-uniformity of the heat generating resistor, and serves also to ensure sufficient electric insulation of the roller surface. This layer also will protect the resistance layer when other objects are accidentally introduced into the nip of the fixing device. The upper insulating layer also can prolong the warm-up time when its thickness is too large, and can impair the electric insulation when its thickness is too small. The preferred range of thickness of the upper insulating layer is 30 200 μm, more preferably about 100 μm.

Roller bodies usually are made of a high-strength aluminum alloy (5056), in order to meet the demand for high formability, as well as uniform and quick heating characteristics. The directly-heating roller of the invention, however, has a body which has a small heat capacity. Preferably, the material of the roller body has a thermal expansion coefficient which approximates that of the ceramic. From this point of view, the roller body of the roller in accordance with the invention is made of iron or an iron alloy. As is well known, soft iron exhibits a thermal expansion coefficient value of $10\times10^{-6}$/deg. the largest among common metals. To shorten the warm-up time, it is preferred to reduce the thickness of the roller body. In the case of a conventional device using a halogen lamp inside an aluminum pipe, it is difficult to reduce the thickness of the aluminum pipe because it cannot stand bending stress caused by the fixing pressures because the bending strength of aluminum pipe (5056) is less than ½ that of soft iron at 200° C.

Further reduction in the roller heat capacity can be accomplished by thinning each layer and thickness of the roller body or by changing materials. A materials change can be accomplished with some difficulty but thinning the thicknesses is easier to carry out.

With respect to heat leakage, convection and radiation from the roller surface cannot be prevented. Leakage to journals can be prevented by using bearings having low thermal conductivity or reducing the cross section of the journals. Using a roller body with low thermal conductity may also reduce the leakage. From this point of view, steel or soft iron is preferable to aluminum alloy as roller body, since steel or soft iron has a lower thermal conductivity and is workable to thin thicknesses. It is also possible to form the roller body an a cylindrical form having a small thickness of 2 mm or less, preferably 1 mm or less, so as to reduce the heat capacity.

A bonding film bonds the lower insulating layer to the surface of the roller body. Ni-Cr-Mo alloy, Ni-Al alloy, Ni-Cr alloy or the like is suitably used as the material of the bonding surface. When such a material is plasma-sprayed on the surface of the roller body, it spontaneously generates heat and is partially oxidized to form an oxide which effectively enhances the strength of bonding with the ceramic. Among materials suitable for the bonding film, powdered Ni coated on the surface thereof with Al and Mo is used most preferably.

The offset-preventing layer coats the surface of the upper insulating layer in order to improve the anti-offset characteristics of the toner images and also for the purpose of insulating and protecting the surface of the roller. Preferably, the offset-preventing layer is formed from a PFA (tetrafluoroethylene-perfluoroalkylvinyl ether copolymer resin) at a thickness of about 30 $\mu$m.

As the directly-heatig roller having the above stated construction comprises insulating layers generally having fine pores therein and chinks between other layers, it happens that a leak current can flow between the heat generating layer and the metal roller body or the machine frame mounting the roller when moisture enters the pores or the chinks in a humid atmosphere. This causes a large reduction in the electric resistivity of the insulating layer. Or the moisture adhered to the side surface of the layers can cause current flow on the side surfaces between the roller body and the heat generating layer.

It is theoretically possible to impregnate a resin material having a high electrical resistivity into pores in the lower insulating layer to safeguard the insulation resistance between the heat generating layer and the roller body.

A resin material can be introduced into the pores in the lower insulating layer by means of plasma spraying, in order to enhance the insulation resistance of the lower insulating layer. The lower insulating layer is formed on the bonding layer uniformly adhered on the onter peripheral surface of the roller body also by means of plasma spraying. But it is difficult to form a heat generating layer comprising a metallic resistance layer extending substantially electrically continuously at least in the lengthwise direction of the roller in the ceramix matrix, by means of plasma spraying, because the resin-impregnated layer surface is too smooth.

The impregnated resin material fills up the pores in the layer, crevices and holes on the outer surface of the layer, and make the surface too even to be coated effectively by a heat generating layer formed by means of plasma spraying because there remain few surface discontinuities to serve as anchors for the heat generating layer.

The ring shaped electrodes are generally made of a Cu-Al alloy. As the Cu-Al alloy has a thermal expansion coefficient of about $20\times10^{-6}$/°C. and a heat generating resistance layer made of a mixture of $Al_2O_3$ ceramic and Ni-Cr alloy has, for example a thermal expansion coefficient of about $9\times10^{-6}$/°C., there exists the possibility that cracks could occur at the boundary portions between the electrodes and the heat generating layer, by repeatedly imposed heat cycles.

Such cracks in the heat generating can cause sparks by a dischange or breaks of an eletric circuit.

The possibility of sparks or breaks is high especially in Europe, the United States of America and other countries where a higher voltage current source is used than one in Japan.

Accordingly, an object of the invention is to provide a directly-heating roller for fixing toner images, which roller has a highly insulated current path, in order to maintain the safety and reliability of the roller.

Another object of the invention is to provide a directly-heating roller for fixing toner images, which has a high insulation resistance between the roller body and the heat generating layer or the electrode layer, even in a humid atmosphere.

To these ends, according to the invention, there is provided a directly-heating roller for fixing toner images comprising: (a) a roller body having a small electrical resistivity; (b) a bonding layer formed substantially uniformly on the outer peripheral surface of the roller body; (c) a lower insulating layer provided on the bonding layer; (d) a heat generating resistance layer provided on the lower insulating layer and having a ceramic matrix and a metallic resistance layer constituted by a metal dispersed in the ceramic matrix, the metallic resistance layer extending substantially electrically continuously at least in the lengthwise direction of the roller; (e) an upper insulating layer provided on the heat generating layer; (f) an offset preventing layer formed on the upper insulating layer so as to prevent offset of the toner images; (g) an electrode layer formed on each end of the roller and adapted to connect the heat generating layer to an external power source; and (h) side protective layers formed at least on the side surfaces of the lower insulating layer and the side surfaces of the heat generating layer.

The side protective layers generally also partially cover the portions of the lower insulating layer surfaces located axially outside the electrode rings.

According to the invention, the side protective layers preferably partially cover the side surfaces of the electrode layer and partially the side surfaces of the roller body, to provide additional insulation.

Each electrode ring is preferably composed of an inner ring made of a mixture of an alloy material and a ceramic material and an outer ring made of a metallic material, in order to prevent cracks caused by the difference of thermal expansion coefficient of the heat generating heat resistance layer and that of a metallic electrode to be attached to the layer. It is desirable to use an inner electrode of a ring shape having a thermal expansion coefficient between the thermal expansion coefficient of the outer electrode and that of the heat generating resistance layer, and an electric resistivity between the resistivity of the outer electrode and that of the resistance layer.

DESCRIPTION OF THE PREFERRED EMBODIMENTS

Figure 1:
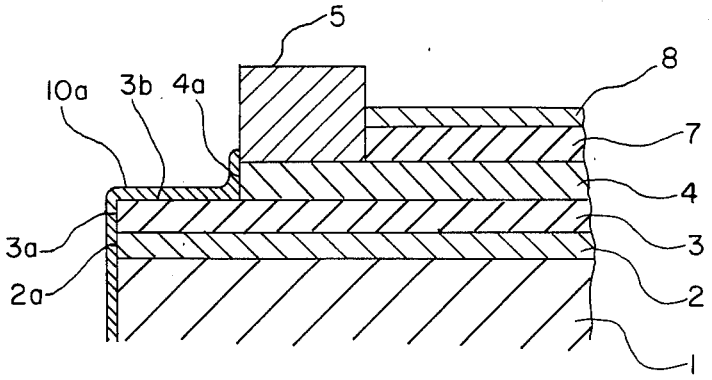
FIG. 1 is an enlarged view of an essential portion of a directly-heating roller in accordance with the invention.
Figure 2:
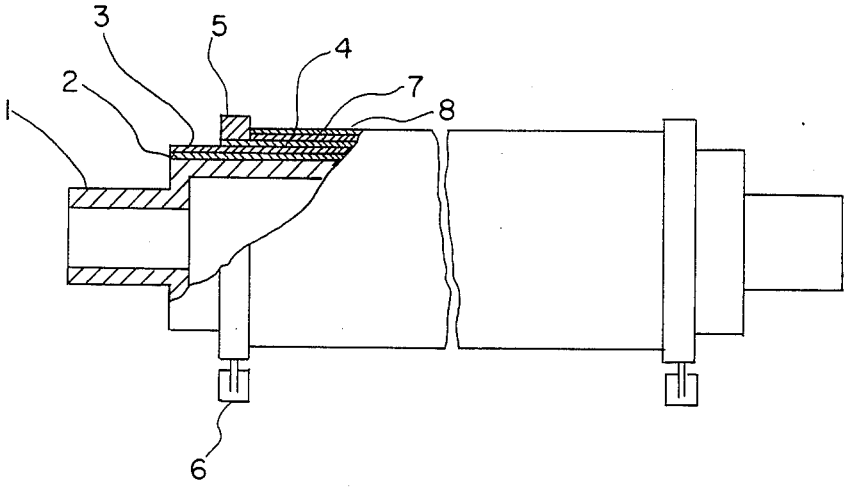
FIG. 2 is a partially vertical sectional over view of a directly-heating roller apparatus without a side protective layer.

Referring to FIG. 1, the side protective layers 10*a* are deposited onto the side surfaces 2*a* of the bonding layer 2, the side surfaces 3*a* and the axially outside portions 3*b* of the lower insulating layer 3, the side surfaces 4*a* of the heat generating layer 4, a portion of the side surfaces of the electrode layers 5 and also a portion of the side surfaces of the roller body 1. The other constructions are the same as ones in the roller shown in FIG. 2. The side protective layers 10*a* are formed by resin impregnation at the side surfaces. The side protective layers are electrically resistive and preferably heat-resistant, because they are intended to be heated repeatedly. They protect the layers and the openings between the layers from moisture and enhance the electrical resistivity of the layers, because the impregnated resin fills up holes and pores of the layers and the openings between layers. The offset preventing layer 8 formed on the upper insulating layer also contributes to prevent the insulating layer and the heat generating layer from absorbing moisture. These protective layers maintain the insulation of the heat generating layer as above stated, protecting it from moisture.

EXAMPLE 1

A cylindrical roller body of soft iron having a 300 mm of length, a 35 mm of outer diameter and a wall thickness of 1.0 mm was prepared. On the shot blasted surface of the roller body, there were formed by a plasma spraying process a Cr metal bonding layer of 300 μm thick, a lower $MaAl_2O_4$ insulating layer of 300 μm thick, a heat generating resistance film of about 55 μm made of a mixture of an Ni-Cr alloy (80 wt%Ni-20 wt%Cr) and $Al_2O_3$ (alloy content 20 wt%), and an $MgAl_2O_4$ upper insulating layer of 300 m thick. After securing the electrodes to both ends of the heat generating resistance film, a PFA (tetrafluoroethylene-prefluoroalkylvinyl ether copolymer resin) protective layer was formed on the upper insulating layer, thus completing a roller having no side protective layers. Four kinds of rollers having side protective layers were produced by similar processes as the above stated process. These four rollers were provided with an fluorocarbon resin layers (A), an epoxy resin layers (B), polyamide resin layers (C) and silicone varnish layers (D), respectively, as the side protective layers. Side protective layers of fluorocarbon resin (A) were formed over all the side surfaces 2*a*, 3*a* and 4*a* of the bonding layer 2, the lower insulating layer 3 and the heat generating layer 4, and also the outside surfaces 3*b* of the layer 3 by means of impregnation. Similarly side protective layers of epoxy resin (B), polyamide resin (C), and silicone varnish (D) were formed on the side surfaces of the respective rollers.

The resistivity value (unit: Ω.cm) of the each of the resins A, B, C and D is as follows:

| | |
|---|---|
| A: fluorocarbon resin | $10^{18}$ |
| B: epoxy resin | $10^{12}$ |
| C: polyamide resin | $10^{16}$ |
| D: silicone varnish | $10^{14}$ |
| (E: No resin impregnation) | |

Figure 3:
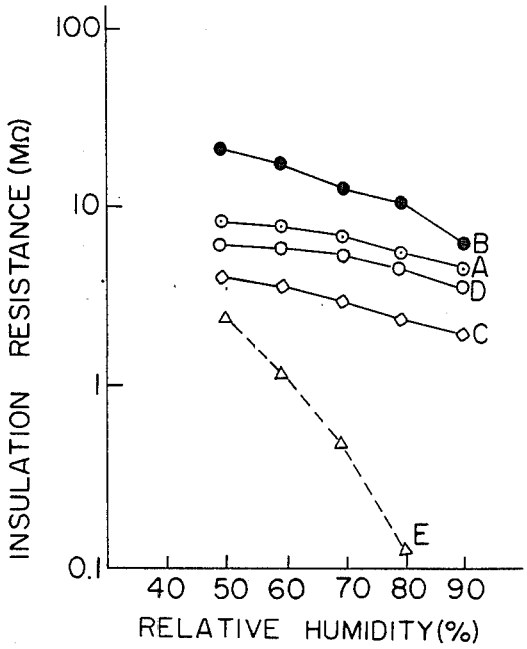
FIG. 3 is a graph showing the relationship between the relative humidity and the insulation resistance of the roller body.

The relative humidity dependence of the electrical resistance between the roller body and the heat generating layer measured at a temperature of 30° C. in each of the roller is shown in FIG. 3. As shown in FIG. 3, the insulating resistance of a roller having no side protective layer (E) drops rapidly as the relative humidity increases.

On the other hand, the insulation resistance does not drop as rapidly in each of the rollers having side protective layer, even when the relative humidity increases.

EXAMPLE 2

A cylindrical roller body having a 300 mm length, a 35 mm outer diameter, and a thickness of 0.6 mm was prepared of soft (SS41). On the shot blasted surface of the roller body, there were formed by a plasma spraying process an Ni-4%Al-2%Mo alloy bonding layer of 25 μm thick, a lower $MgAl_2O_4$ insulating layer 300 μm thick, a heat generating resistance film of 70 μm thick made a mixture of an Ni-Cr alloy (80 wt%Ni-20 wt%Cr) and an $Al_2O_3$ (alloy content 20 wt%), and an $MgAl_2O_4$ upper insulating layer 100 μm thick. After securing the electrodes to both ends of the heat generating resistance film, a PEA (tetrafluoroethylene-perfluoroalkylvinyl ether copolymer resin) protective layer was formed on the upper insulating layer and over all the side surfaces of the bonding layer, the lower insulating layer and the heat generating layer, and also the outside surfaces of the insulating layer by means of electrostatic spraying. The protective layer on the upper insulating layer helps to prevent moisture absorption and off-set, so it is preferably made of a resin having heat resistive characteristics.

For the resin material used for the protective layer, PFA is preferably. A PFA resin is an copolymer resin of tetrafluoroethylene and perfluoroalkylvinyl ether wherein the ether has a chemical composition formula: $C_nF_{2n+1}$—C—CF=$CF_2$ (n: an integral of 1~5). The PFA resin was coated on the upper insulating layer and on the side surfaces by means of electrostatic spraying which comprise steps of electrification of PFA resin powder, spraying of the PFA resin powder on the surfaces and fusion fixing of the PFA on the surfaces by means of heating. The PFA resin powder preferably has a mean particle size of 2~150 μm, more preferably 5~75 μm, and an apparent density to the bulk resin of less than 0.74, more preferably 0.35–0.6. The PFA resin powder preferably has a total surface area of less than or equal to 10 $m^2/cm^3$ and a nearly round shape, preferably with few pores therein. MP-10 (Mitsu-Fluoro Chemical) or 532-5010 (Du-Pont) is a preferable kind of PFA resin powder. The MP-10 resin can be electrostatically sprayed on the surfaces by applying 60 KV voltage differential, heating to a temperature of 380° C. for 10 minutes, and then forming a protective layer having a thickness of about 60 μm, thus completing fabrications of the directly-heating roller.

A plasma spray apparatus used in this experiment comprised a gun body having a central path for flowing an inert carrier gas, argon. Part of the path was enclosed by an anode, and a rod-type cathode was mounted in the path. A path for supplying powder mixtures to be sprayed was open to the central path near the gun nozzle opening.

With argon flowing through the central path of the gun, a plasma arc was provided between the anode and the cathode. The electrical voltage differential applied was 50 to 100 V. The arc turned the argon into a high-temperature plasma jet apparatus without a side protective layer than 5000° C.

Powders to be sprayed were supplied through the side path into the plasma formed in the central path. The roller was rotated to help form a uniform deposited layer with the roller placed at a distance of 10 cm from the plasma jet.

When a Ni-Al-Mo alloy plasma-sprayed layer was deposited, the spraying condition was as follows:

Arc current: 500 A.

Arc voltage: 70 V DC.

Powder Supply Rate: 25 lb/hr.

When a insulating $MgAl_2O_4$ layer was deposited, the spraying condition was as follows:

Arc current: 500 A.

Arc voltage: 80 V DC.

Powder Supplying Rate: 6 lb/hr.

When the heat generating resistance film was deposited, the spraying condition was as follows:

Arc current: 500 A.

Arc voltage: 80 V DC.

Powder Spraying Rate: 6 lb/hr.

Electric current was supplied to the completed roller such that it produced a power of 900 Watts for heating the roller surface up to 200° C. The warm-up time was 22 seconds the directly-heating roller of the invention has a very short warm-up time.

EXAMPLE 3

The directly-heating roller having the roller body thickness of 0.6 mm employed in Example 1 was subjected to a repetitional heat cycle test. In this test, the heating roller was held in contact with a rubber roller of a diameter substantially the same as that of the heating roller, while being rotated at a peripheral speed of 200 mm/sec. The heat cycle test was conducted by applying the roller to repetitional heat cycles each having a 2 minute period. The heat roller in accordance with the invention showed no breakdown of the resistance layer and no deterioration in the electric characteristics, even after 2600 continuous heat cycles.

EXAMPLE 4

A continuous heat-rotation test was carried out in a box having a relative humidity of 80% using a fixing unit of the same type used in Example 3. Neither breakdown of the resistance layer nor deterioration in the electric characteristics and off-set of images was observed after 300-hours of operation at the maximum temperature of 220° C., thus proving the superiority of the heating roller of the invention.

Although in the above-stated examples, we mentioned only some resin materials to be coated on the surfaces located axially outside of the electrode rings, other resin materials, glass materials or ceramic materials having a high heat resistivity, good moisture protective characteristics, and a high electrical resistivity, can be used. The protective layer material used on the side surfaces can be different from the material on the upper insulating layer.

EXAMPLE 5

Figure 4:
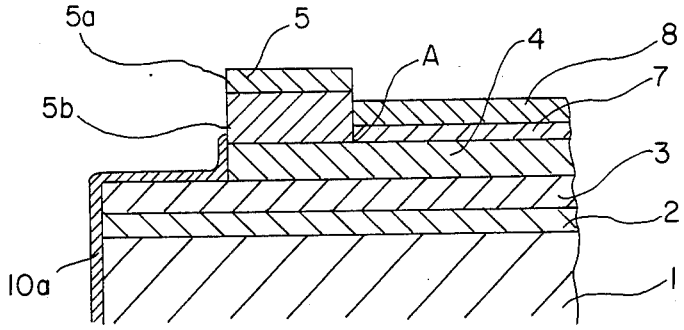
FIG. 4 is an enlarged view of an essential portion of another directly-heating roller in accordance with the invention.

A directly-heating roller for fixing toner images as shown in FIG. 4 was produced by a process which was similar to the process in Example 1, except for the construction of the electrodes. The electrode 5 having a ring shape is comprised of an inner layer **5*b* and an outer layer 5*a*, as shown in FIG. 4. The outer ring 5*a* is made of a Cu-Al alloy and the heat generating resistance layer 4 is made of a mixture of an Ni-Cr alloy (80 wt%Ni-20 wt%Cr) and $Al_2O_3$ (alloy content: 20 wt%). The inner ring 5*b*** is made of a mixture of an Ni-Cr alloy (80 wt%Ni-20 wt%Cr) and $Al_2O_3$ (alloy content: 40 wt%). This electrode structure prevents cracks from occurring at boundary portion (A), because the inner ring helps to relax stresses at the boundary. As the outer ring electrode and the inner ring electrode are bonded to relax the stresses at the boundary between the rings, no cracks occurs at the boundary.

The inner ring or the outer ring can be made of various other materials respectively according to the invention.

The essential point is that the inner ring has a thermal coefficient and an electrical resistance coefficient between the respective values of the resistance layer and the outer ring.

EXAMPLE 6

Figure 5:
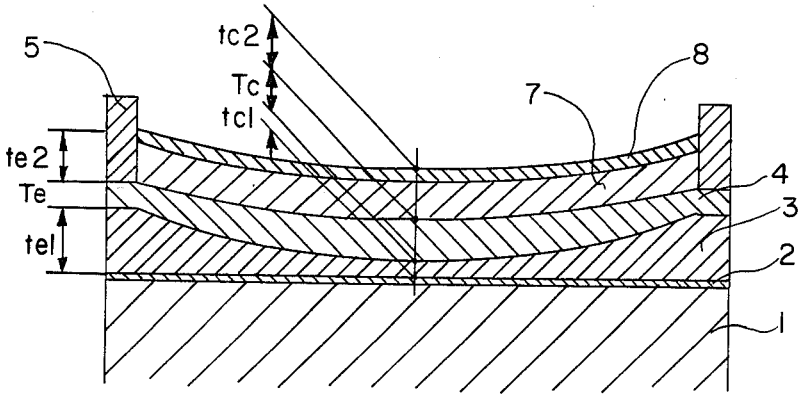
FIG. 5 is an enlarged partially vertical sectional view of yet another embodiment of the invention.

A roller according to the invention was made by a process which was similar to the process in Example 1. The partial vertical sectional view of the roller is shown in FIG. 5.

The essential point of this embodiment is that the total thickness at the axial end roller portions of the lower insulating layer, the upper insulating layer and the offset preventing layer are preferably bigger by 20%~70% than the corresponding values at the axial central portion. This construction is preferable in order to make the heat distribution more axially uniform at the outer surface of the roller, because the end portion can be heated up more easily than the central portion. Another point is that the heat generating layer thickness at the axially end portion is smaller than that at the axially central portion also to make the heat distribution more axially uniform. The radius at the central portion of the roller is preferably small by 40 μm~60 μm at the end portion (exaggerated in FIG. 5 for purpose of illustration) in order to prevent wrinkles in the paper during the fixing operation.

What is claimed is:

1. A directly-heating roller for fixing toner images comprising:

(a) a roller body having a small resistivity;

(b) a bonding layer formed substantially uniformly on the outer peripheral surface of said roller body;

(c) a lower insulating layer provided on said bonding layer;

(d) a heat generating resistance layer provided on said lower insulating layer and having a ceramic matrix and a metallic resistance layer constituted by a metal dispersed in said ceramic matrix, said metallic resistance layer extending substantially continuously in the lengthwise direction of said roller;

(e) an upper insulating layer provided on said heat generating layer;

(f) an offset preventing layer formed on said upper insulating layer so as to prevent offset of said toner images;

(g) an electrode layer formed on each end of said roller and adapted to connect said heat generating layer to an external power source; and (h) side protective layers formed at least on the side surfaces of the lower insulating layer and on the heat generating layer.

2. A directly-heating roller according to claim 1, wherein said metallic resistance layer is made of a material essentially consisting of 10 to 35 wt% of an Ni-Cr alloy and the balance substantially ceramic.

3. A directly-heating roller according to claim 2, wherein said Ni-Cr alloy essentially consists of 5 tp 20 wt% of Cr and the balance substantially Ni.

4. A directly-heating roller according to claim 3, wherein said ceramic is $Al_2O_3$.

5. A directly-heating roller according to claim 1, wherein said heat insulating layer has a thermal expansion coefficient which is not smaller than $6\times10^{-6}$/deg.

6. A directly-heating roller according to claim 5, wherein said lower insulating layer has a thickness ranging between 200 and 500 μm.

7. A directly-heating roller according to claim 6, wherein said lower insulating layer has a thickness of 300 μm, while said upper insulating layer has a thickness of about 100 μm.

8. A directly-heating roller according to claim 5, wherein said heat insulating layer is made of an oxide selected from a group consisting of $Al_2O_3$, MgO, $ZrO_2$, $MgAl_2O_4$, $ZrO_2.SiO_2$, and Mno.Nio.

9. A directly-heating roller according to claim 8, wherein said oxide is $MgAl_2O_4$.

10. A directly-heating roller according to claim 8, wherein said oxide is $Al_2O_3$.

11. A directly-heating roller according to claim 10, wherein the wall thickness of said roller body is not greater than 2 mm.

12. A directly-heating roller according to claim 1, wherein the roller body is made of iron or iron alloy.

13. A directly-heating roller according to claim 11, wherein the wall thickness of said rolelr body is not greater than 1 mm.

14. A directly-heating roller according to claim 1, wherein said bonding layer is made of a material selected from a group which consists of Ni-Al-Mo alloy, Ni-Al alloy and Ni-Cr alloy, and is partially oxidized.

15. A directly-heating roller according to claim 1, wherein the side protective layers are made of PFA resin.

16. A directly-heating roller according to claim 15, wherein the offset preventing layer on the upper insulating layer is also made of PFA.

17. A directly-heating roller according to claim 1, wherein the offset preventing layer on the upper insulating layer is formed by means of electrostatic spraying.

18. A directly-heating roller according to claim 1, wherein the side protective layers are formed by means of resin impregtation.

19. A directly-heating roller according to claim 1, wherein the electrode layer is composed of an inner ring layer and an outer ring layer, and the inner ring layer has a thermal expansion coefficient between the thermal expansion coefficient of the heat generating resistance layer and one of the outer ring layer.

* * * * *